US007760147B2

(12) United States Patent
Nam

(10) Patent No.: US 7,760,147 B2
(45) Date of Patent: Jul. 20, 2010

(54) ANTENNA AND MOBILE COMMUNICATION TERMINAL COMPRISING THE SAME

(75) Inventor: Soo Hyun Nam, Seoul (KR)

(73) Assignee: LG Electronics, Inc., Seoul (KR)

( * ) Notice: Subject to any disclaimer, the term of this patent is extended or adjusted under 35 U.S.C. 154(b) by 15 days.

(21) Appl. No.: 11/944,297

(22) Filed: Nov. 21, 2007

(65) Prior Publication Data

US 2008/0111749 A1 May 15, 2008

(30) Foreign Application Priority Data

Nov. 23, 2006 (KR) ..... 10-2006-0116280

(51) Int. Cl.
*H01Q 1/24* (2006.01)

(52) U.S. Cl. ..... 343/702; 343/700 MS; 343/841; 343/895

(58) Field of Classification Search ..... 343/702, 343/700 MS, 841–848, 793, 797, 810–820, 343/850, 778, 864, 872, 860, 895
See application file for complete search history.

(56) References Cited

U.S. PATENT DOCUMENTS 5,936,584 A * 8/1999 Lawrence et al. ..... 343/702
6,867,746 B2 * 3/2005 Mendolia et al. ..... 343/841
7,411,556 B2 * 8/2008 Sanz et al. ..... 343/702
7,605,765 B2 * 10/2009 Ku ..... 343/702

* cited by examiner

*Primary Examiner*—James H. Cho
*Assistant Examiner*—Christopher Lo
(74) *Attorney, Agent, or Firm*—Lee, Hong, Degerman, Kang & Waimey

(57) ABSTRACT

A mobile terminal and antenna including a case configured to include a circuit board and an antenna disposed inside the case. The antenna including an antenna pattern formed on a substrate, a feed unit having a first end connected to the antenna pattern and a second end connected to the circuit board. The feed unit is configured to supply an electrical signal to the antenna pattern, and an Electromagnetic Interference (EMI) attenuation unit is disposed in a location corresponding to the feed unit and configured to attenuate the EMI generated by the feed unit.

19 Claims, 11 Drawing Sheets

ANTENNA AND MOBILE COMMUNICATION TERMINAL COMPRISING THE SAME

CROSS-REFERENCE TO RELATED APPLICATIONS

Pursuant to 35 U.S.C. §119(a), this non-provisional application claims priority under 35 U.S.C. §119(a) on Patent Application No. 10-2006-0116280 filed in Korea on Nov. 23, 2006, the entire contents of which are hereby incorporated by reference.

FIELD OF INVENTION

The present invention relates generally to wireless communications, and more particularly to an antenna for attenuating electromagnetic interference.

DESCRIPTION OF RELATED ART

In general, an antenna provides a mechanism for receiving externally introduced electric waves and for transmitting signals, which are transferred from other internal or external units. The antenna is an indispensable component of a mobile terminal, that is, a wireless communication device. The antenna permits transmitting/receiving signals to and from a base station, thus improving the communication.

In a mobile terminal having an antenna mounted therein, if a Specific Absorption Rate (SAR) is high, indicating a measurement value as Electromagnetic Interference (EMI) absorption power per unit mass absorbed by the human body, then there may be an adverse effect on the human body. Thus, the SAR has been regulated not to exceed a specific reference value.

In order to improve the SAR characteristic, an antenna matching procedure may be used. A typical antenna matching technique involves matching a frequency, affecting the SAR characteristic, which is mismatched so as to decrease the level of an electric wave that is actually output.

If this method is employed, the SAR level is decreased since a signal level radiated from the antenna is decreased. However, the intensity of an output signal is also decreased. Accordingly, there is a disadvantage in that the antenna sensitivity characteristic or transmission characteristic is degraded.

Furthermore, in order to reduce the influence of EMI, a method of mounting an EMI absorbent made of a ferrite material in a device surface of the mobile terminal is commonly employed. However, the effect of using the method is to only absorb parasitic EMI rather than absorbing a radiation electric wave of the antenna. Accordingly, there is a problem in that current methods do not improve the SAR characteristic.

SUMMARY OF THE INVENTION

In one general aspect of the invention, a mobile terminal and antenna includes a case configured to include a circuit board and an antenna disposed inside the case. The antenna includes an antenna pattern formed on a substrate, a feed unit having a first end connected to the antenna pattern and a second end connected to the circuit board. The feed unit is configured to supply an electrical signal to the antenna pattern, and an Electromagnetic Interference (EMI) attenuation unit is disposed in a location corresponding to the feed unit and configured to attenuate the EMI generated by the feed unit.

It is contemplated that the feed unit further includes a metal contact formed on one side of the substrate and a feed point connected to the metal contact, wherein the EMI attenuation unit is formed on the metal contact. It is further contemplated that the EMI attenuation unit absorbs and reflects the EMI generated by the feed unit.

It is contemplated that the EMI attenuation unit includes a material having a dielectric constant, wherein the dielectric constant gradually increases from a dielectric constant similar to air to a higher dielectric constant. It is further contemplated that the EMI attenuation unit of the antenna forms one of a polygon and an elliptical shape.

It is contemplated that the EMI attenuation unit comprises a width and a length which are respectively greater than a width and a length of the metal contact. It is further contemplated that the feed unit is formed to permit surface mounting of the feed unit.

It is contemplated that the feed unit is formed on a rear surface of the substrate wherein the antenna pattern is formed on a front surface of the substrate, and the feed unit connects to the antenna pattern through a via hole.

It is further contemplated that the mobile terminal further includes a first body, a second body comprising the case, and a hinge rotatably connecting the first body and the second body. The antenna is positioned in the second body at a location which is proximately located to the hinge.

In another embodiment of the present invention, an antenna adapted to reduce electromagnetic interference (EMI) in a mobile terminal is provided, the mobile terminal includes a substrate having a front surface and a rear surface, an antenna pattern formed on the substrate, a feed unit connected to one end of the antenna pattern, configured to supply an electrical signal, and an EMI attenuation unit for attenuating EMI generated by the feed unit.

It is contemplated that the feed unit includes a metal contact formed on one side of the substrate and a feed point connected to the metal contact, wherein the EMI attenuation unit is formed on the metal contact. It is further contemplated that the EMI attenuation unit comprises a width and a length which are respectively smaller than a width and a length of the metal contact.

It also is contemplated that the feed unit and the antenna pattern may be formed on the same substrate surface.

Additional features and advantages of the invention will be set forth in the description which follows, and in part will be apparent from the description, or may be learned by practice of the invention. It is to be understood that both the foregoing general description and the following detailed description of the present invention are exemplary and explanatory and are intended to provide further explanation of the invention as claimed. These and other embodiments will also become readily apparent to those skilled in the art from the following detailed description of the embodiments having reference to the attached figures, the invention not being limited to any particular embodiments disclosed.

BRIEF DESCRIPTION OF THE DRAWINGS

The above and other objects, features and advantages of the present invention will be more apparent from the following detailed description taken in conjunction with the accompanying drawings.

DETAILED DESCRIPTION OF THE INVENTION

Figure 1:
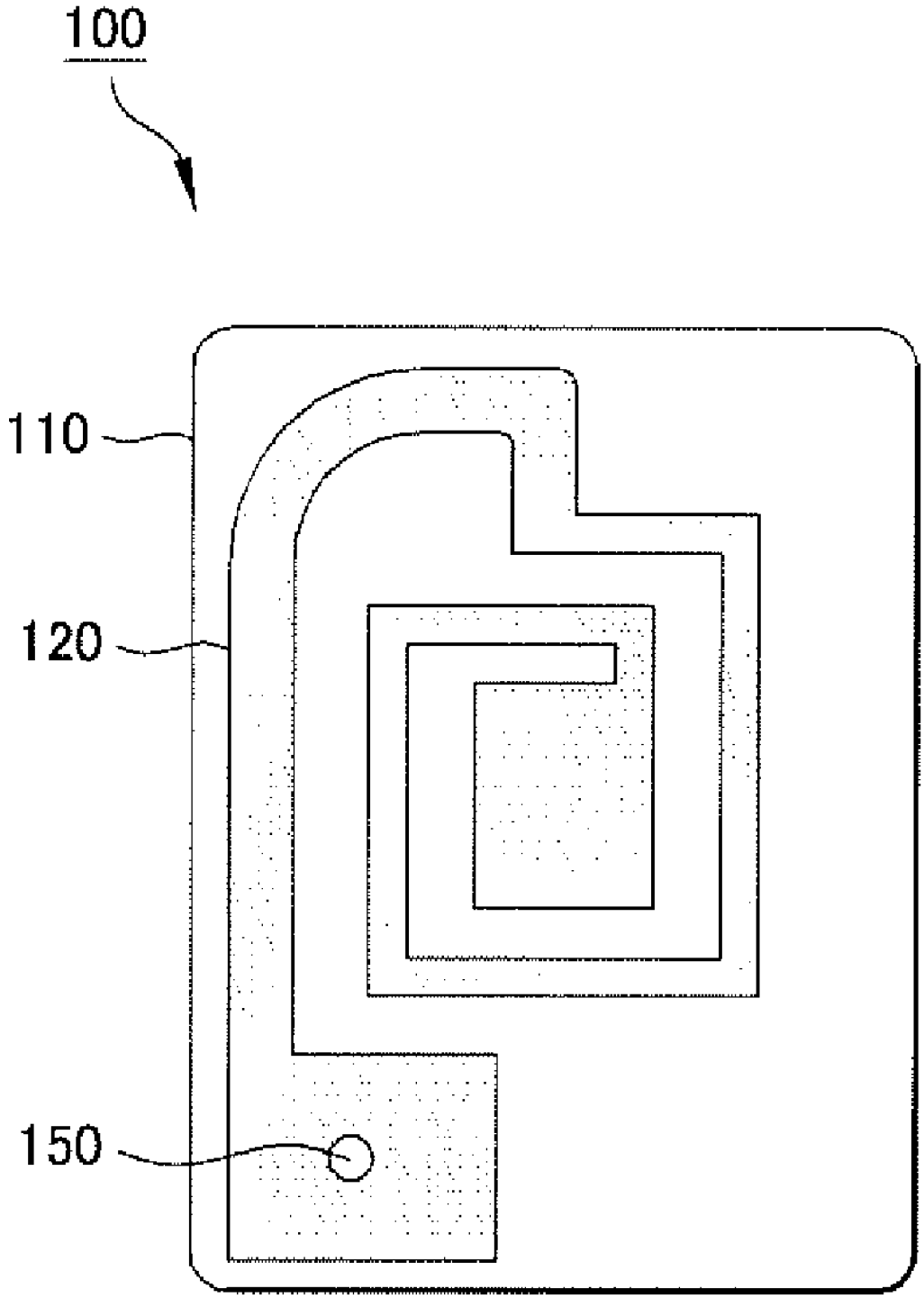
FIG. 1 is a front view of an antenna according to an embodiment of the present invention.

An antenna and a mobile terminal comprising the same according to an embodiment of the present invention will now be described in detail in connection with specific embodiments with reference to the accompanying drawings. In the accompanying drawings, the same reference numerals are used to denote the same functional elements through the accompanying drawings.

Figure 2:
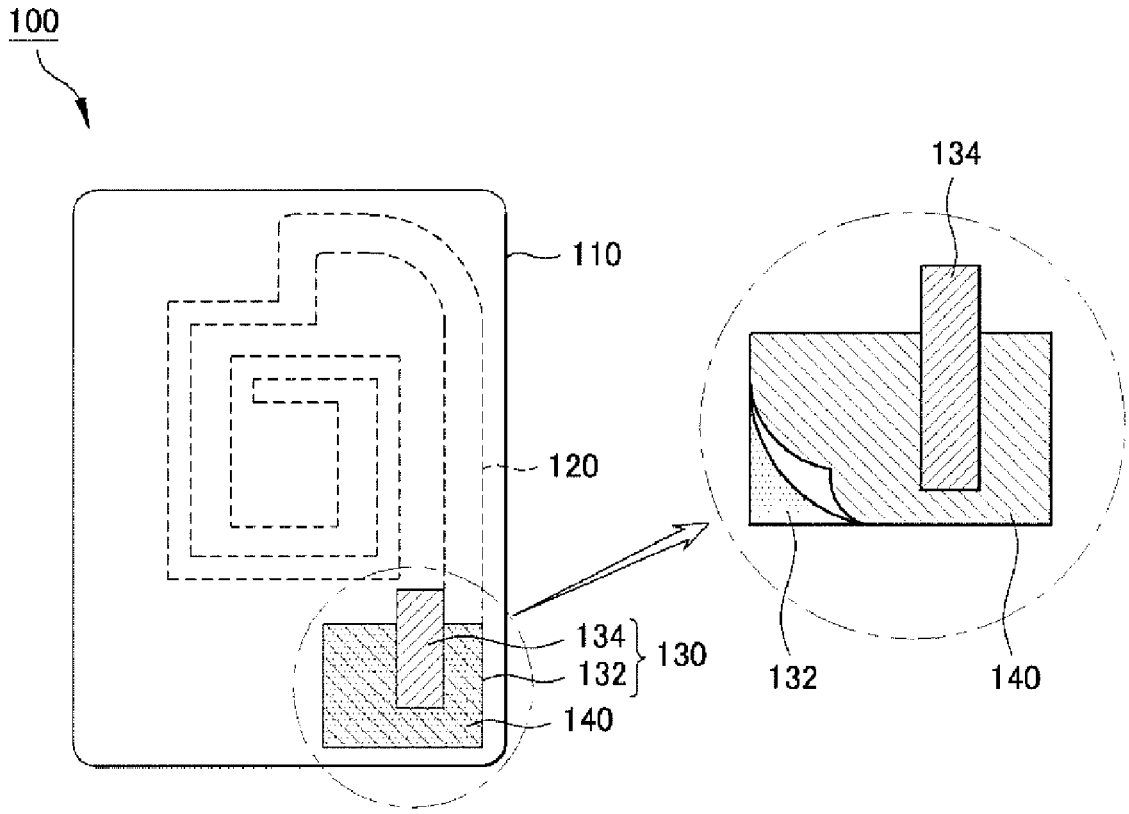
FIG. 2 is a rear view of the antenna of FIG. 1 with an enlarged view of the feed unit and the attenuation unit.

Forming an Antenna Pattern and a Feed Unit on the Front and Rear Surfaces of a Substrate FIG. 1 is a front view of an antenna according to an embodiment of the present invention. FIG. 2 is a rear view of the antenna according to an embodiment of the present invention.

Referring to FIGS. 1 and 2, the antenna 100 includes a substrate 110, an antenna pattern 120, a feed unit 130 and an EMI attenuation unit 140. The substrate 110 is a structure on which the antenna pattern 120 and the feed unit 130 are formed.

The antenna pattern 120 is formed on a front side of the substrate 110, and a portion of which has a straight-line shape. The antenna pattern 120 can have different lengths and widths depending on the frequency range to be transmitted and received. Thus, the shape of the antenna pattern 120 to which an embodiment of the present invention is applied is not limited to the embodiments herein.

The feed unit 130 is attached to the antenna 100 and a feed circuit (not shown), and applies an electrical signal to the antenna pattern 120 of the antenna 100. The feed unit 130 can be surface mounted on the substrate 110 rear surface in which the antenna pattern 120 is formed.

The feed unit 130 comprises a metal contact 132 and a feed point 134. The metal contact 132 is formed on one side of the substrate 120 and configured to allow the feed point 134 to be surface mounted to the metal contact 132.

The feed unit 130 is formed on the substrate 110 rear surface in which the antenna pattern 120 is formed, and is therefore connected to the antenna pattern 110 through a via hole 150.

The EMI attenuation unit 140 serves to attenuate EMI generated from the feed unit 130 at a location corresponding to the feed unit 130. The EMI attenuation unit 140 can attenuate EMI by absorbing and reflecting EMI generated by the feed unit 130.

The operation of the antenna according to an embodiment of the present invention is described below.

Figure 3:
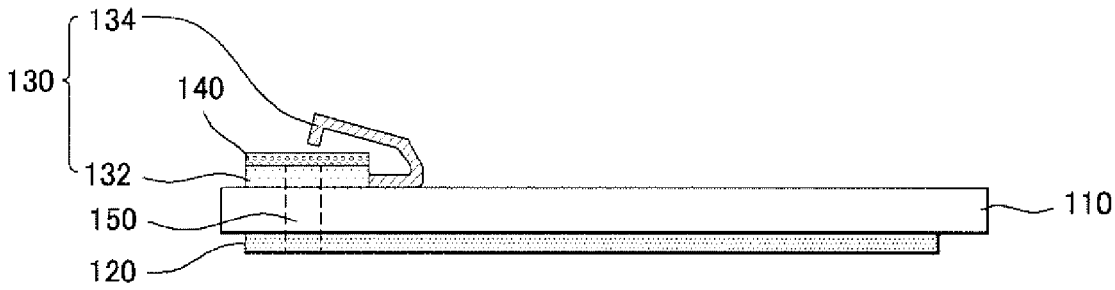
FIG. 3 is a side view of the antenna of FIG. 1.

FIG. 3 is a side view of the antenna according to an embodiment of the present invention. As illustrated in FIG. 3, the antenna pattern 120 of the antenna 100 is formed on the substrate 110 front surface.

The feed unit 130 is formed at a location corresponding to one end of the antenna pattern 120 on the rear surface of the antenna substrate 110. Accordingly, since electric power can be supplied from the rear surface of the substrate 110, the antenna 100 can be installed with the substrate being turned over on the front surface. The antenna 100 is freely installed without being restricted due to the location where the antenna pattern 120 is formed.

The metal contact 132 of the feed unit 130 is formed at a location corresponding to one end of the antenna pattern 120 on the rear surface of the substrate 110, and is connected to the feed point 134. The feed point 134 can be made from a conductive material and positioned in order to facilitate electrical connectivity with the feed circuit (not shown).

The EMI attenuation unit 140 is formed on the feed unit 130. The EMI attenuation unit 140 can attenuate EMI generated when electric power is supplied from the feed unit 130 to the antenna pattern 120. This is described below in more detail with reference to FIG. 4.

Figure 4:
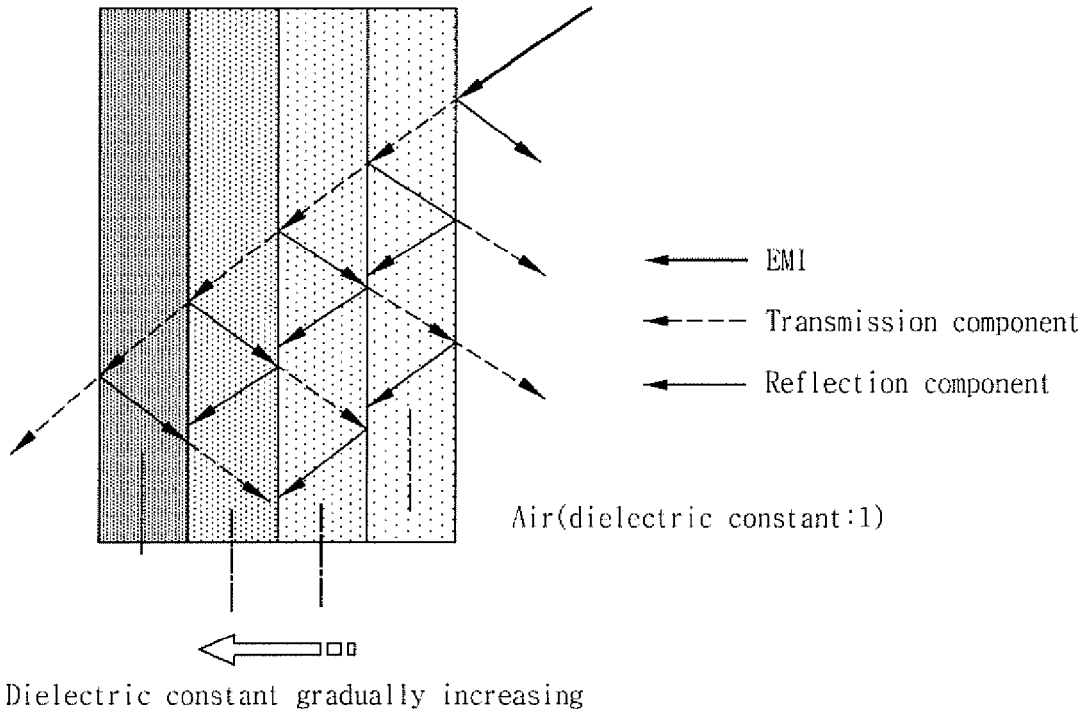
FIG. 4 illustrates the dielectric constant material of an EMI attenuation unit according to an embodiment of the present invention.

FIG. 4 illustrates the dielectric constant material of the EMI attenuation unit according to an embodiment of the present invention.

As illustrated in FIG. 4, the EMI attenuation unit 140 absorbs incident EMI components, and consumes the EMI components by converting the EMI components into heat or energy.

For example, EMI that is generated when electric power is supplied from the feed unit 130 to the antenna pattern 120 is processed as it contacts the EMI attenuation unit 140. The EMI is divided into a transmission component and a reflection component when the EMI is brought in contact with other materials. Accordingly, the EMI is divided into the transmission component and the reflection component when the EMI is brought in contact with the EMI attenuation unit 140.

Herein, the greater the difference in the dielectric constant between materials constituting the EMI attenuation unit 130, the greater the reflection component. Thus, making it difficult to transmit or reflect EMI.

Accordingly, the material of the EMI attenuation unit 130 is gradually changed from a material having a dielectric constant similar to that of the air to a material having a high dielectric constant in order to minimize the reflection component.

As described above, EMI that is generated when electric power is supplied from the feed unit 130 to the antenna pattern 120 is converted into heat or radiated in different directions while undergoing an infinite transmission or reflection process between dielectric materials having different dielectric constants.

An example in which EMI that is generated when electric power is supplied from the feed unit 130 to the antenna pattern 120 is transmitted or reflected due to the EMI attenuation unit 140 is described below with reference to FIGS. 5 and 6.

Figure 5:
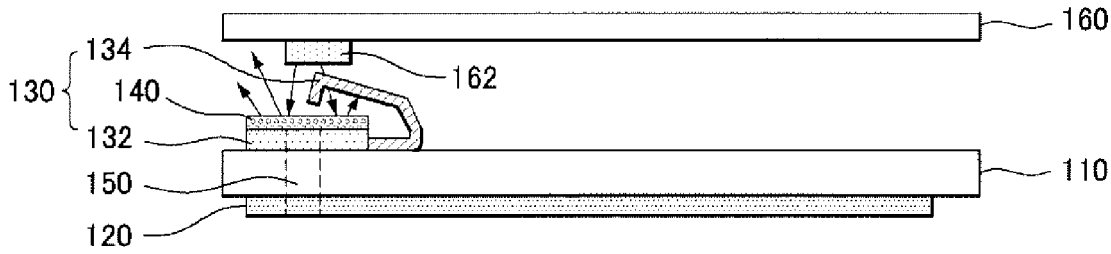
FIG. 5 illustrates an example in which EMI is absorbed or reflected due to the EMI attenuation unit.

FIG. 5 illustrates an example wherein EMI is transmitted or reflected due to the EMI attenuation unit. FIG. 6 is an enlarged view illustrating the example wherein EMI is transmitted or reflected through the EMI attenuation unit of FIG. 5.

Figure 6:
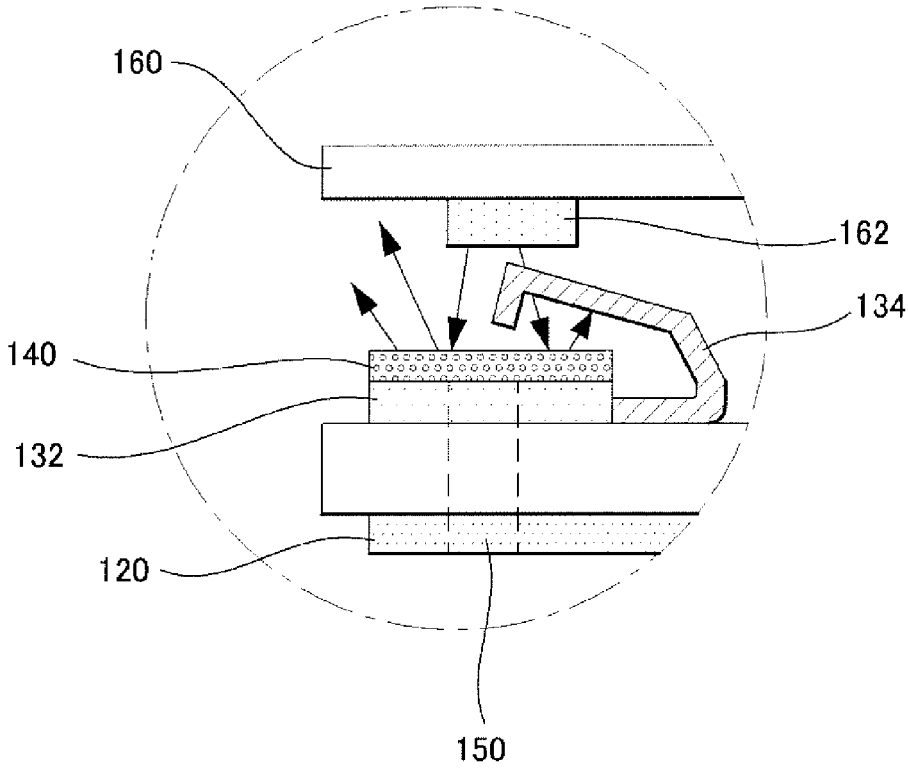
FIG. 6 is an enlarged view of the example illustrated in FIG. 5, in which EMI is transmitted or reflected through the EMI attenuation unit.

As illustrated in FIGS. 5 and 6, the feed point 134 is connected to a feed hole 162 of a second substrate 160 including a feed circuit (not shown) in order to supply an electrical signal to the antenna pattern 120 formed on the front surface of the first substrate 120.

Therefore, an electrical signal is supplied through the feed point 134 of the feed unit 130 from the feed hole 162 of the second substrate 160 having the feed circuit. The electrical signal is supplied to the antenna pattern 120 through the via hole 150.

In this case, the EMI attenuation unit 140 formed on the metal contact 134 of the feed unit 130 attenuates EMI, which is generated when power is supplied, through a transmission and reflection process, as illustrated in FIGS. 5 and 6.

In the above embodiment, it has been described that the feed unit 130 and the antenna pattern 120 are formed on different surfaces of the substrate 110, and are connected by the via hole 150. However, this embodiment of the present invention is not limited to the above embodiment, and may comprise the following embodiments.

Forming an Antenna Pattern and the Feed Unit on One Surface of the Substrate

Figure 7:
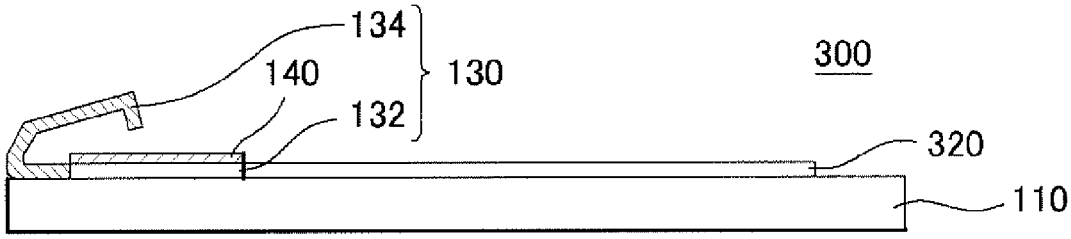
FIG. 7 is a side view of the antenna of the present invention wherein an antenna pattern and a feed unit are formed on one side of a substrate according to another embodiment of the present invention.

FIG. 7 is a lateral view of an antenna wherein the antenna pattern 320 and the feed unit 130 are formed on one surface of the substrate 110 according to another embodiment.

Referring to FIG. 7, the antenna pattern 320 and the feed unit 130 are formed on one surface of the substrate 110. The antenna pattern 320 and the feed unit 130 can both be formed on either the front surface or the rear surface of the substrate 110, as opposed to one element formed on the front surface and the other on the rear surface.

The metal contact 132 of the feed unit 130 is connected to the antenna pattern 320 and the feed point 134.

The EMI attenuation unit 140 is formed on the metal contact 132 of the feed unit 130. The EMI attenuation unit 140 can attenuate EMI that is generated when power is supplied from the feed unit 130 to the antenna pattern 110, in the same manner as above.

Furthermore, in the above embodiment, it has been described that the EMI attenuation unit 140 is formed on the feed unit 130 that can be surface mounted. However, the present invention is not limited to the above embodiment, but may also comprise the following embodiment.

Forming the EMI Attenuation Unit on the Feed Point of the Feed Unit

Figure 8:
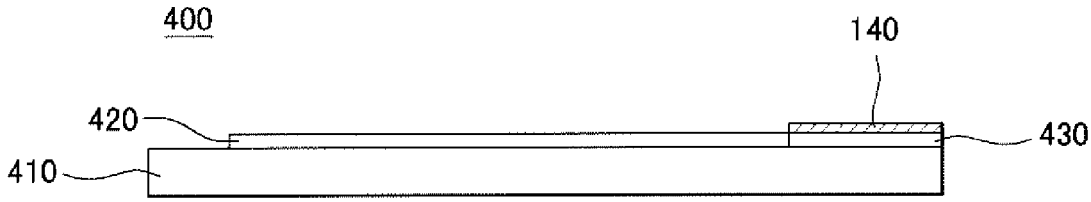
FIG. 8 is a side view of the antenna in which the EMI attenuation unit is formed in the feed unit according to another embodiment of the present invention.

FIG. 8 is a side view of an antenna in which the EMI attenuation unit is formed in the feed unit according to another embodiment of the present invention.

As illustrated in FIG. 8, the antenna 400 has the antenna pattern 420 and the feed unit 430 formed on one surface of the substrate 410. The antenna pattern 410 and the feed unit 430 can be formed on either the front surface or the rear surface of the substrate 410, in the same manner as above.

The EMI attenuation unit 140 is formed on the feed unit 430. The EMI attenuation unit 140 can attenuate EMI that is generated when power is supplied from the feed unit 430 to the antenna pattern 420, in the same manner as above.

In the above embodiments, it has been described that the EMI attenuation unit 140 is formed on the feed unit 430 to have the same size as that of the feed unit 430 such that the EMI attenuation unit 140 and the feed unit 430 correspond to each other. However, this embodiment of the present invention is not limited thereto. That is, the EMI attenuation unit 140 and the feed unit 430 can be formed in different sizes. This is described below with reference to FIG. 9.

Figure 9:
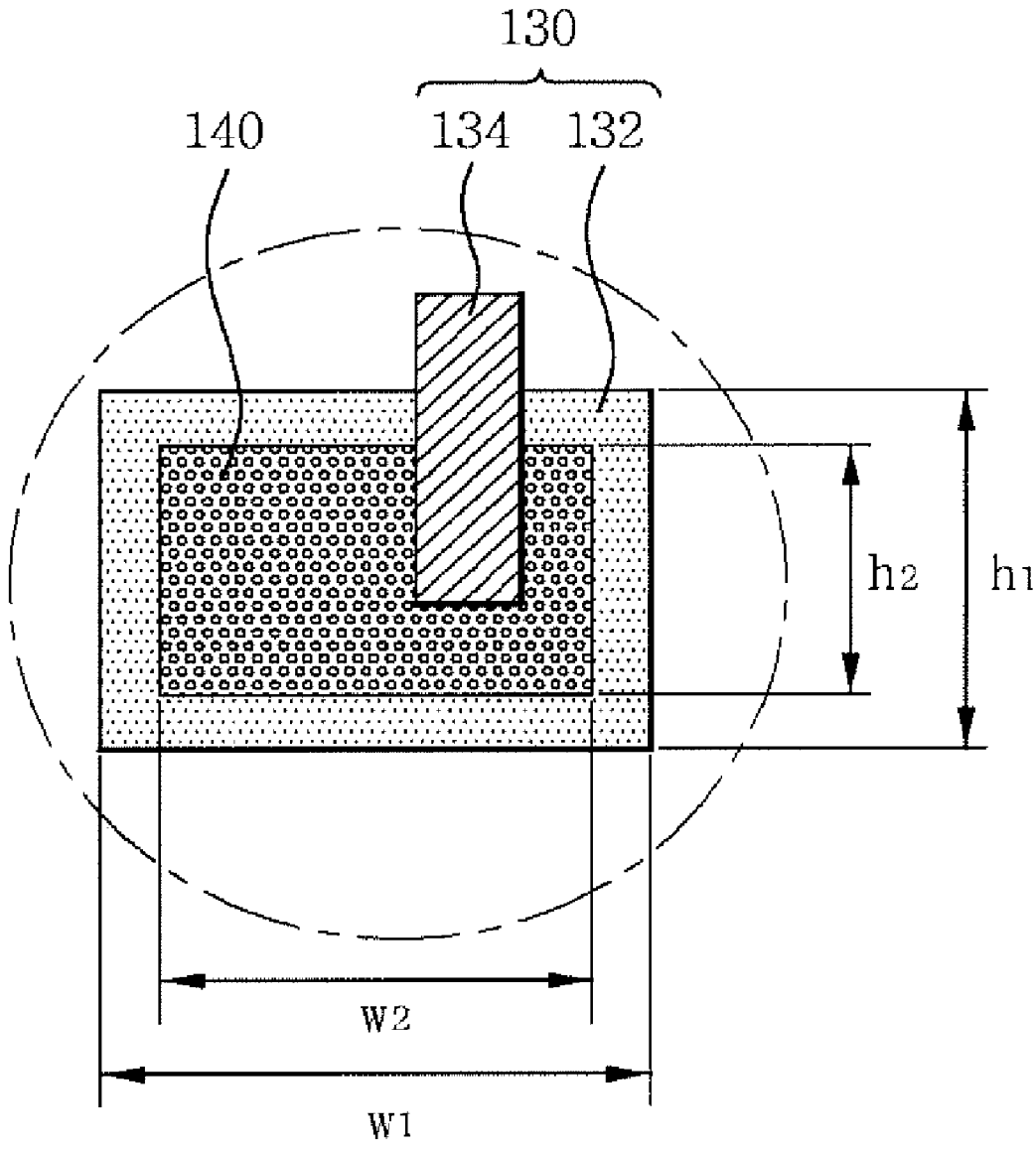
FIG. 9 illustrates the EMI attenuation unit having a size different from the size of the feed unit.

FIG. 9 illustrates an example wherein the EMI attenuation unit has a size different from that of the feed unit.

As illustrated in FIG. 9, the EMI attenuation unit 140 can have a different size from that of the metal contact 132 of the feed unit 130. That is, a width $w_1$ and length $h_1$ of the metal contact 132 of the feed unit 130 can be greater than a width $w_2$ and length $h_2$ of the EMI attenuation unit 140.

Alternatively, the width $w_1$ and length $h_1$ of the metal contact 132 of the feed unit 130 can be smaller than the width $w_2$ and length $h_2$ of the EMI attenuation unit.

In the above embodiments, it has been illustrated that the shape of the EMI attenuation unit 140 is square. However, the present invention is not limited to the above embodiments. That is, the EMI attenuation unit 140 can be formed in various shapes. An example of which is described with reference to FIGS. 10A and 10B.

Figure 10A:
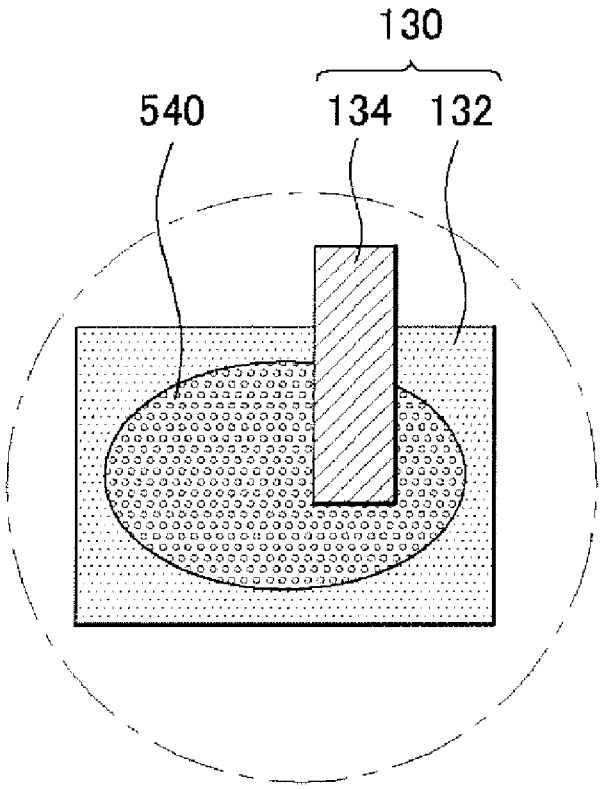
FIGS. 10A and 10B illustrate examples in which the EMI attenuation unit forms a variety of shapes.
Figure 10B:
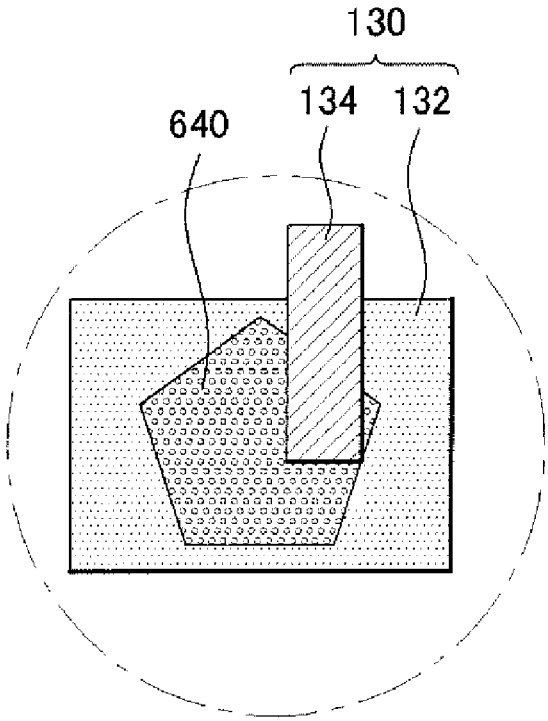

FIGS. 10A and 10B illustrate an example wherein the EMI attenuation unit has a variety of shapes. As illustrated in FIG. 10A, the EMI attenuation unit 540 forms an elliptical shape. Alternatively, the EMI attenuation unit 640 can form a polygon, such as a pentagon, as illustrated in FIG. 10B. The EMI attenuation unit can form the same shape as the feed unit 130 of the metal contact 132.

Mobile Terminal Including an Antenna

Figure 11:
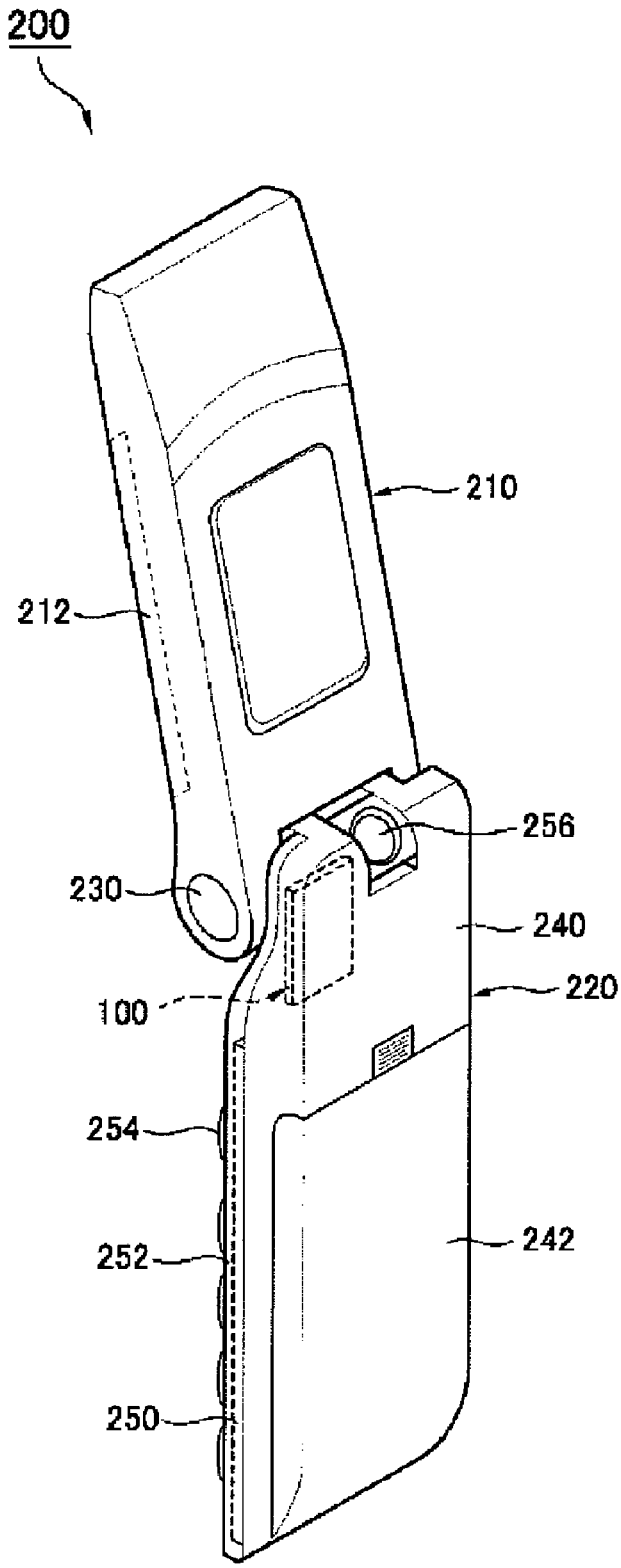
FIG. 11 is a perspective view of a mobile terminal comprising the antenna according to an embodiment of the present invention.

FIG. 11 is a perspective view of a mobile terminal 200 including an antenna according to an embodiment of the present invention.

Referring to FIG. 11, the mobile terminal 200 includes an upper folder unit 210 and a lower folder unit 220, and a hinge 230 rotatably coupled to both the upper folder unit 210 and the lower folder unit 220. The upper folder unit 210 includes a display 212 to form a first body.

The lower folder unit 220 further includes a rear casing 240 and a front casing 250, to form a second body. The rear casing 240 has the antenna unit 100 mounted therein, and is provided with a battery 242. The front casing 250 includes a main PCB (printed circuit board) 252 having a feed circuit (not shown), a keypad 254, and a camera 256.

The rear casing 240 of the lower folder unit 220 is described below in detail with reference to FIG. 12.

Figure 12:
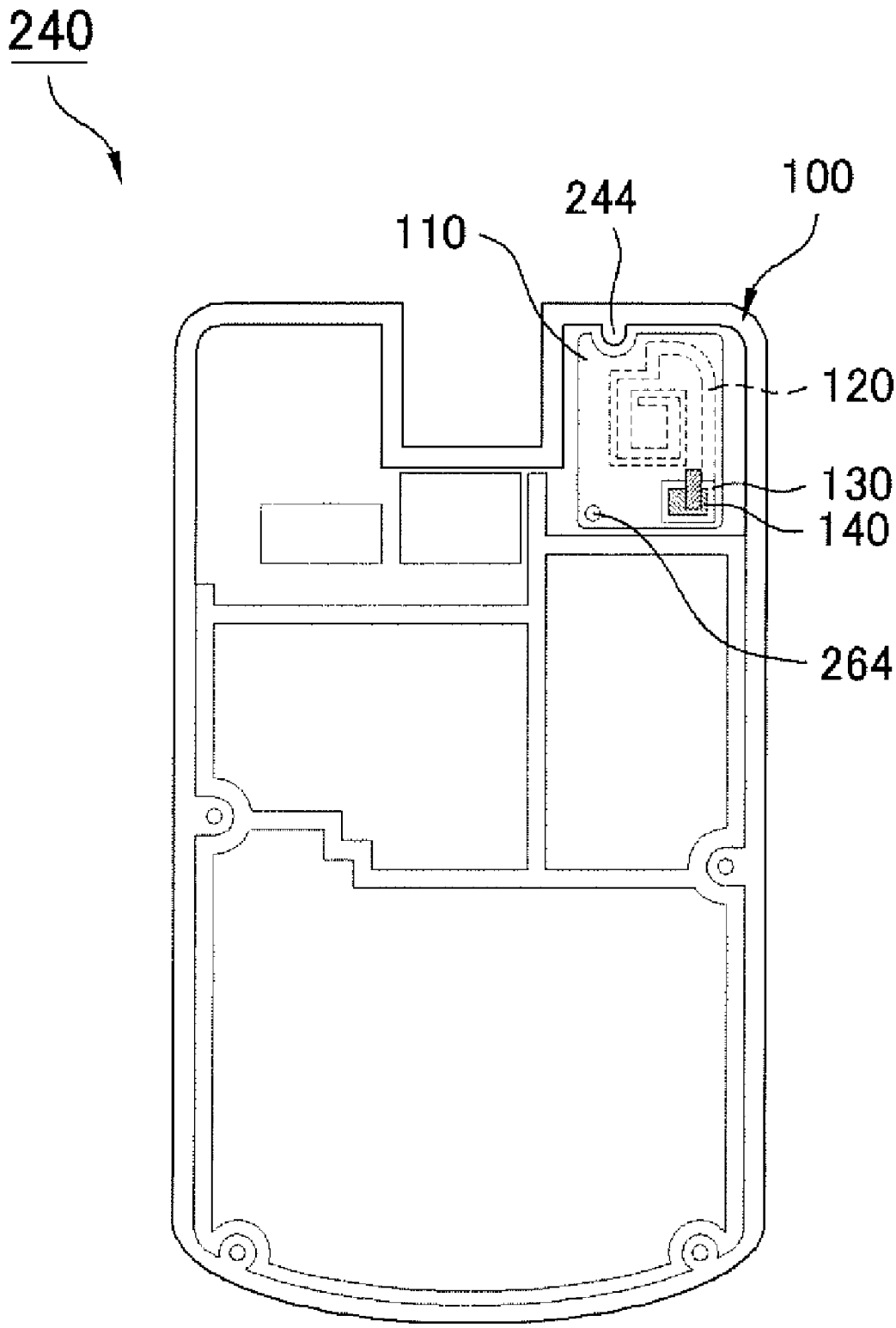
FIG. 12 is a plan view of a rear casing of a lower folder unit in which the antenna is mounted.

FIG. 12 is a plan view of a rear casing of the lower folder unit in which an antenna is mounted. As illustrated in FIG. 12, a space 244 for mounting the antenna unit 100 is formed at the bottom of the hinge, referring to element 230 in FIG. 11, in the rear casing 240 of the lower folder unit 220.

The space 244 may be formed by a fixed injection unit, that is, a fixed latch for attaching the antenna unit 100 before the substrate 110 of the antenna unit 100 and the rear casing 240 of the mobile terminal 200 are coupled through a coupling 264.

When the antenna unit 100 is mounted in the space 244, the antenna pattern 120 formed on the front surface of the substrate 110 is located inside the rear casing 240 of the mobile terminal 200. Furthermore, the feed unit 130 formed on the rear surface of the substrate 110 is located on the inside front casing outside of the rear casing 240. Accordingly, the EMI attenuation unit 140 formed on the feed unit 130 is also located inside the front casing and outside the rear casing 240.

The coupling 264 is formed on one side of the antenna substrate 110 in order to stabilize the coupling of the substrate 110 of the antenna 120 and the rear casing 240 of the mobile terminal 200. The coupling unit 264 stably couples the antenna 120 and the rear casing 240 of the mobile terminal 200 using a screw, or other attachment device.

When using the mobile terminal 200, the antenna 120 is located close to the users head, but the EMI attenuation unit 140 is formed on the feed unit 130. Accordingly, the SAR characteristic in which EMI generated by the feed unit 130 which would be absorbed by the user's head can be reduced.

The principle of reducing and/or shielding EMI when a user holds a wireless phone call using the mobile terminal 200 including the antenna 100 is described below with reference to FIG. 13.

Figure 13:
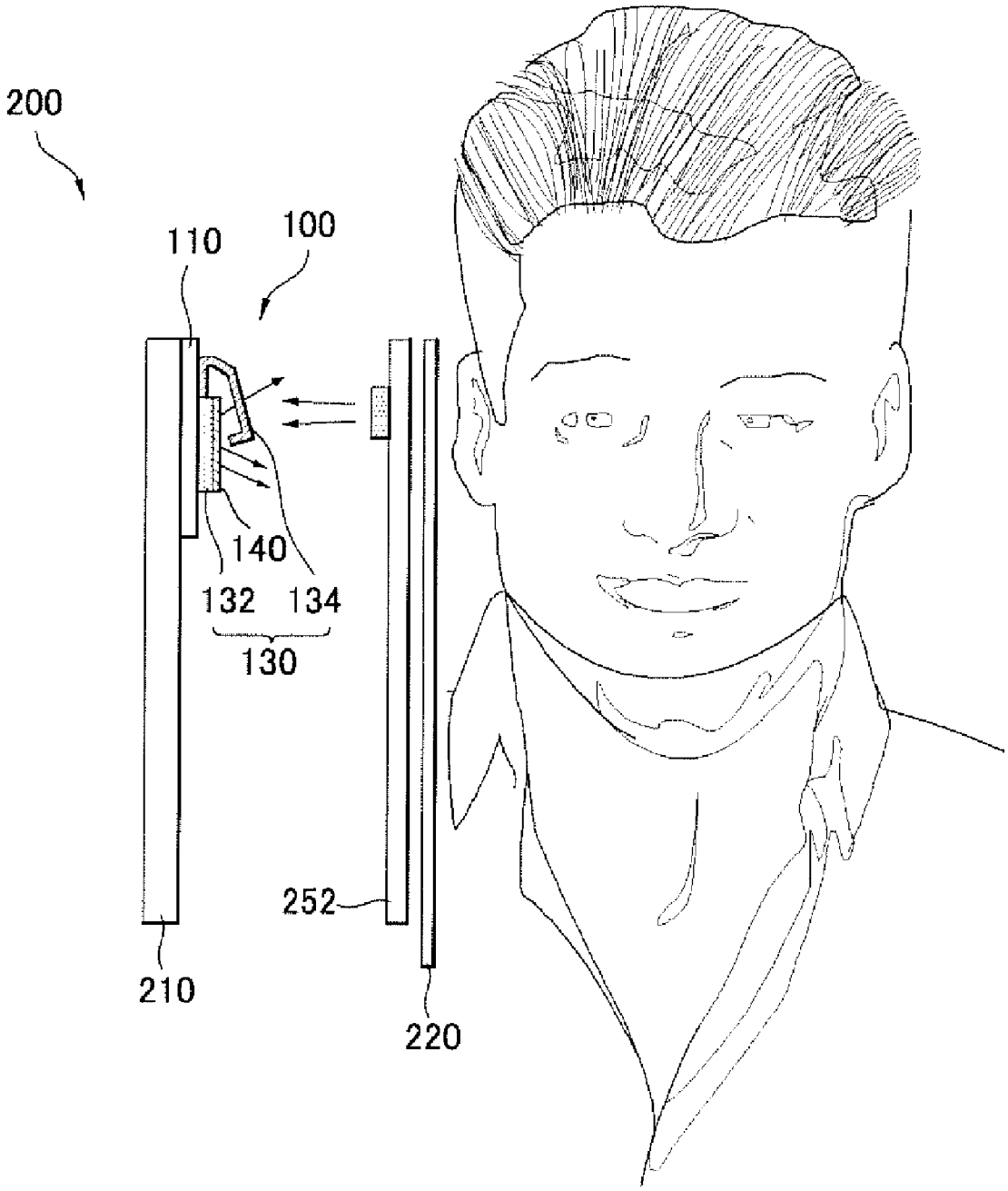
FIG. 13 illustrates EMI shielding when a user uses the mobile terminal comprising the antenna according to an embodiment of the present invention.

FIG. 13 is a view illustrating that EMI is shielded when a user uses the mobile terminal 200 comprising an antenna 100 of an embodiment of the present invention.

As illustrated in FIG. 13, when using the mobile terminal 200, the antenna 100 is mounted in the rear casing 240 (refer to 240 in FIG. 11) of the lower folder unit 220, that is, the second body. At this time, the antenna 100 is mounted in a location corresponding to the head of the user at the top of the rear casing of the lower folder unit 220.

Therefore, EMI is generated by the feed unit 130 for supplying an electrical signal from the main PCB 252 to the antenna pattern 110 of the antenna 100. However, the EMI attenuation unit 140 formed on the metal contact 132 of the feed unit 130 absorbs EMI components, which are radiated from the feed unit 130 of the antenna to the front of the mobile terminal 200, and reflect EMI components radiated backward.

Reflection loss depending on frequencies of the mobile terminal 200, including the antenna 100 in which the EMI attenuation unit 140 is formed on the feed unit 130, is described below with reference to FIG. 14.

Figure 14:
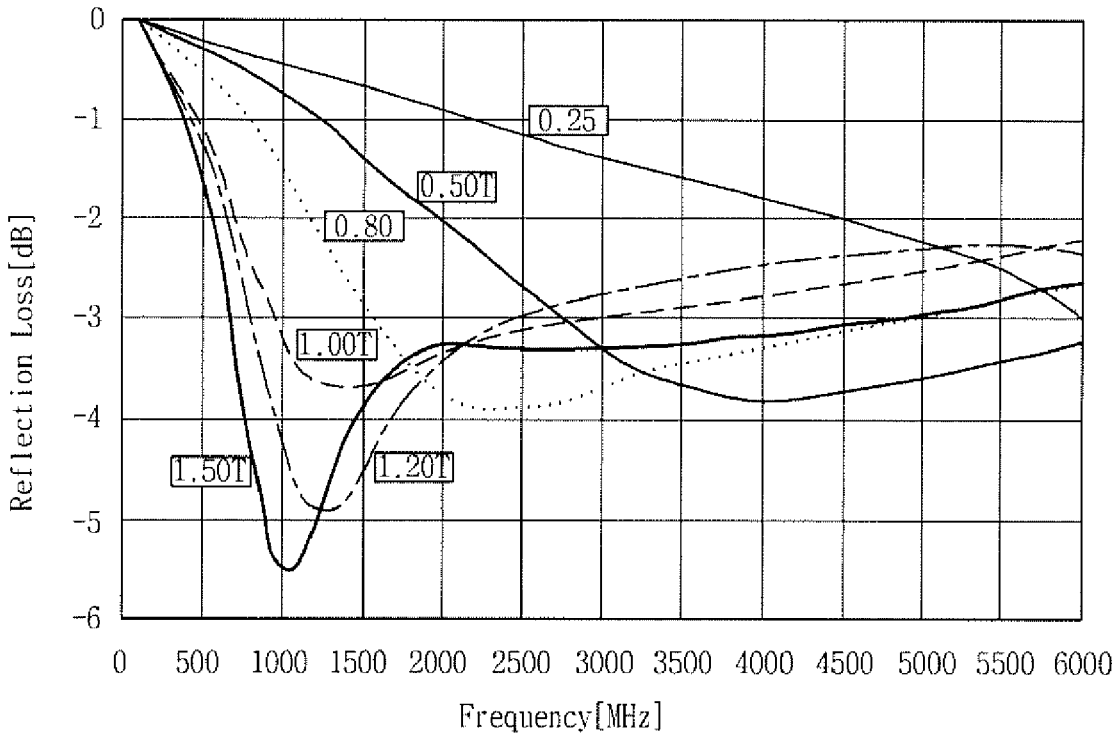
FIG. 14 is a graph illustrating reflection loss depending on frequencies according to an embodiment of the present invention.

FIG. 14 is a graph illustrating reflection loss depending on frequencies according to an embodiment of the present invention.

FIG. 14 shows that in a 1900 MHz band, Total Radiated Power (TRP) was reduced to 0.8 dB or less and Total Isotropic Sensitivity (TIS) was reduced to 0.5 dB or less. It reveals that the SAR characteristic was improved 0.16 or more.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

As described above, according to the present invention, the EMI attenuation unit is formed in the feed unit of the antenna. Accordingly, EMI generated by the antenna can be attenuated and the SAR characteristic can be improved.

The embodiments of the present invention have been described for illustrative purposes, and those skilled in the art will appreciate that various modifications, additions, and substitutions are possible without departing from the scope and spirit of the invention as disclosed in the accompanying claims. Therefore, the scope of the present invention should be defined by the appended claims and their legal equivalents.

What is claimed is:

1. A mobile terminal, comprising:

a case configured to include a circuit board; and an antenna disposed inside the case, the antenna comprising:

an antenna pattern formed on a substrate;

a feed unit having a first end connected to the antenna pattern and a second end connected to the circuit board, and configured to supply an electrical signal to the antenna pattern; and an Electromagnetic Interference (EMI) attenuation unit disposed in a location corresponding to the feed unit and configured to attenuate EMI generated by the feed unit, wherein the EMI attenuation unit comprises a material having a dielectric constant that is variable and comprising at least two layers having different dielectric constants, wherein the feed unit further comprises a metal contact formed on one side of the substrate and a feed point connected to the metal contact, wherein the EMI attenuation unit is formed on the metal contact, and wherein the metal contact, the EMI attenuation unit, and the substrate are laminated such that a surface of a first side of the metal contact is in contact with a surface of the one side of the substrate, and a surface of a second side of the metal contact is in contact with a surface of one side of the EMI attenuation unit, the second side of the metal contact being an opposite side of the first side.

2. The mobile terminal of claim 1, wherein the EMI attenuation unit absorbs and reflects the EMI generated by the feed unit.

3. The mobile terminal of claim 1, wherein the dielectric constant gradually increases from a dielectric constant similar to air to a higher dielectric constant.

4. The mobile terminal of claim 1, wherein the EMI attenuation unit of the antenna forms one of a polygon and an elliptical shape.

5. The mobile terminal of claim 1, wherein the EMI attenuation unit comprises a width and a length which are respectively greater than a width and a length of the metal contact.

6. The mobile terminal of claim 1, wherein the feed unit is formed to permit surface mounting of the feed unit.

7. The mobile terminal of claim 1, wherein the feed unit is formed on a rear surface of the substrate and the antenna pattern is formed on a front surface of the substrate, and wherein the feed unit is connected to the antenna pattern through a via hole.

8. The mobile terminal of claim 1, further comprising:

a first body;

a second body comprising the case; and a hinge rotatably connecting the first body and the second body, wherein the antenna is positioned in the second body at a location which is proximately located to the hinge.

9. An antenna configured to reduce electromagnetic interference (EMI) in a mobile terminal, the antenna comprising:

a substrate having a front surface and a rear surface;

an antenna pattern formed on the substrate;

a feed unit connected to one end of the antenna pattern and configured to supply an electrical signal to the antenna pattern; and an EMI attenuation unit for attenuating the EMI generated by the feed unit, wherein the EMI attenuation unit comprises a material having a dielectric constant that is variable and comprising at least two layers having different dielectric constants, wherein the feed unit further comprises a metal contact formed on one side of the substrate and a feed point connected to the metal contact, wherein the EMI attenuation unit is formed on the metal contact, and wherein the metal contact, the EMI attenuation unit, and the substrate are laminated such that a surface of a first side of the metal contact is in contact with a surface of the one side of the substrate, and a surface of a second side of the metal contact is in contact with a surface of one side of the EMI attenuation unit, the second side of the metal contact being an opposite side of the first side.

10. The antenna of claim 9, wherein the EMI attenuation unit is configured to provide at least one of absorbing and reflecting the EMI generated by the feed unit.

11. The antenna of claim 9, wherein the dielectric constant gradually increases from a dielectric constant similar to air to a higher dielectric constant.

12. The antenna of claim 9, wherein the EMI attenuation unit forms one of a polygon and an elliptical shape.

13. The antenna of claim 9, wherein the EMI attenuation unit comprises a width and a length which are respectively greater than a width and a length of the metal contact.

14. The antenna of claim 9, wherein the EMI attenuation unit comprises a width and a length which are respectively smaller than a width and a length of the metal contact.

15. The antenna of claim 9, wherein the feed unit is surface mounted on a rear surface of the substrate in which the antenna pattern is formed.

16. The antenna of claim 9, wherein the feed unit is formed on a rear surface of the substrate and the antenna pattern is formed on the front surface of the substrate, wherein the feed unit is connected to the antenna pattern through a via hole.

17. The antenna of claim 9, wherein the feed unit and the antenna pattern are formed on the same substrate surface.

18. The mobile terminal of claim 1, wherein a size of the EMI attenuation unit is different from a size of the metal contact.

19. The antenna of claim 9, wherein a size of the EMI attenuation unit is different from a size of the metal contact.

* * * * *